United States Patent [19]

Niederste-Hollenberg et al.

[11] 4,216,737

[45] * Aug. 12, 1980

[54] LIFT CONTROL DEVICE FOR PROPELLER DRIVE SYSTEMS ON WATERCRAFTS

[75] Inventors: Heinz Niederste-Hollenberg, Gauting; Christoph Sacher; Friedrich Fickenscher, both of Munich; Johann Eichinger, Putzbrunn, all of Fed. Rep. of Germany

[73] Assignee: Carl Hurth Maschinen- und Zahnradfabrik, Munich, Fed. Rep. of Germany

[ * ] Notice: The portion of the term of this patent subsequent to Feb. 6, 1994, has been disclaimed.

[21] Appl. No.: 7,212

[22] Filed: Jan. 29, 1979

Related U.S. Application Data

[62] Division of Ser. No. 778,151, Mar. 16, 1977, Pat. No. 4,137,862.

[30] Foreign Application Priority Data

Mar. 24, 1976 [DE] Fed. Rep. of Germany ..... 2612564
Nov. 6, 1976 [DE] Fed. Rep. of Germany ..... 2650879

[51] Int. Cl.[2] ..... B63H 5/12
[52] U.S. Cl. ..... 440/61

[58] Field of Search ..... 115/41 R, 41 HT; 248/640, 641, 642, 643

[56] References Cited

U.S. PATENT DOCUMENTS

| | | | |
|---|---|---|---|
| 2,997,014 | 8/1961 | Puckett | 115/41 X |
| 3,008,445 | 11/1961 | Frank | 115/41 HT |
| 3,577,953 | 5/1971 | Braun | 115/41 HT |
| 3,589,326 | 6/1971 | Celli | 115/41 X |
| 3,859,952 | 1/1975 | Celli | 115/41 R |
| 3,893,407 | 7/1975 | Hurst | 115/41 R |
| 4,137,862 | 2/1979 | Niederste-Hollenberg et al. | 115/41 HT |

*Primary Examiner*—Sherman D. Basinger
*Attorney, Agent, or Firm*—Blanchard, Flynn, Thiel, Boutell & Tanis

[57] ABSTRACT

An improved lift control in a steerable propeller or Z-drive for watercrafts. The drive includes a transmission shaft which extends from the engine to a point below the water level and to the propeller. The transmission shaft is arranged in the housing. For purposes of tilting the housing out of the water and/or trimming the angle of thrust, at least one pressure cylinder is provided and is arranged in the housing which contains the transmission shaft.

2 Claims, 9 Drawing Figures

LIFT CONTROL DEVICE FOR PROPELLER DRIVE SYSTEMS ON WATERCRAFTS

This is a division, of application Ser. No. 778,151 filed Mar. 16, 1977, now U.S. Pat. No. 4,137,862.

FIELD OF THE INVENTION

The invention relates to a steerable propeller or Z-drive and more particularly, to a steerable propeller or Z-drive having at least one lift cylinder therein arranged in the housing which contains the transmission shaft.

BACKGROUND OF THE INVENTION

It is known in steerable propellers or Z-drives to more or less pivot the housing which contains the transmission shaft and the propeller hydraulically about a substantially horizontal axis for the purpose of tilting the propeller out of the water or trimming same. For this purpose life cylinders are provided, which are arranged besides the housing, or if a cavitation plate is provided, near same. The thus arranged lift cylinders have the disadvantage that they hinder the flow.

The basic purpose of the invention is to arrange the lift cylinder or the lift cylinders favorably with respect to flow.

The arrangement has also the advantage that the steerable propeller or Z-drive has a closed form and that the lift cylinders with the connecting parts cannot or only with great difficulties be injured.

The lift cylinder can actually be installed such that at the end of the cylinder there is provided a joint and at the end of the piston rod there is provided a different joint to thus achieve a kinematically satisfactory arrangement.

Further advantages and characteristics of the invention can be taken from the following description.

BRIEF DESCRIPTION OF THE DRAWINGS

The invention will be described hereinafter in connection with the exemplary embodiments illustrated in FIGS. 1 to 8.

DETAILED DESCRIPTION

Figure 1:
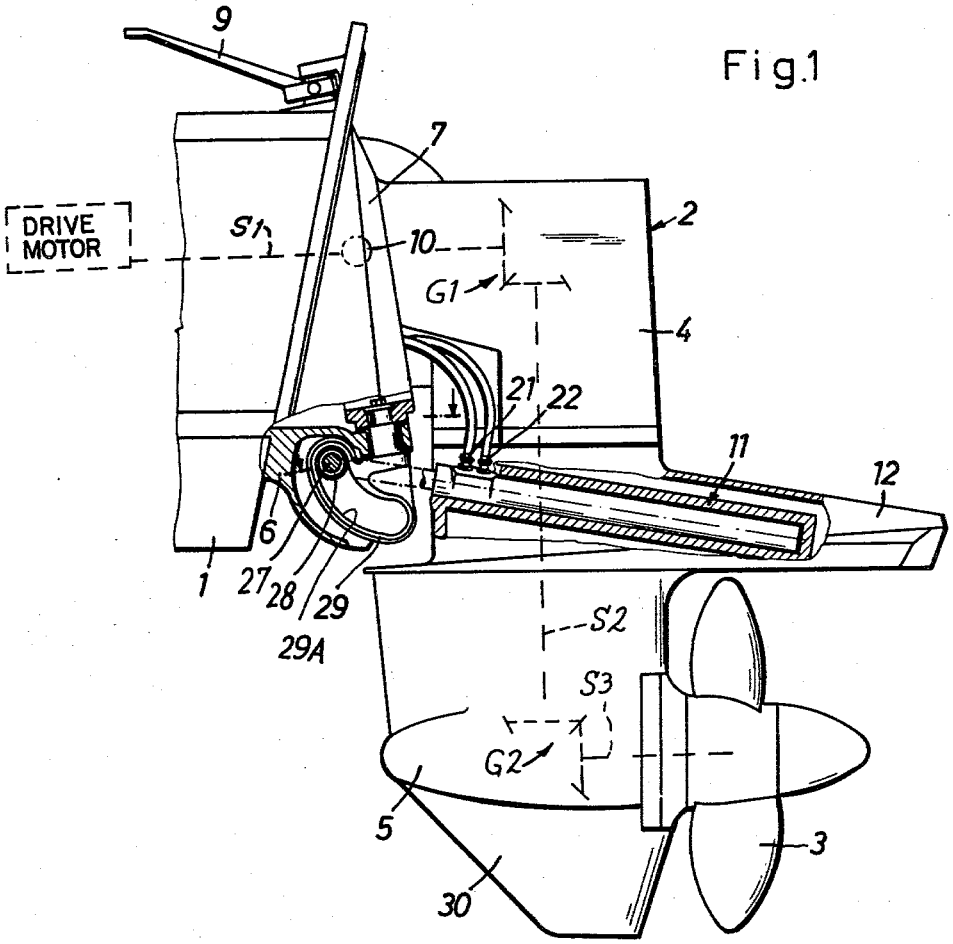
FIG. 1 illustrates a steerable propeller according to the invention with hinging of the piston rods through a rocker arm.

A steerable propeller 2 is secured in a known manner and with known means at the rear of a watercraft 1 for driving and controlling the watercraft. The drive machine, a motor, is mounted in the hull of the ship and is schematically illustrated. The output of the motor is transmitted through known and therefore schematically illustrated transmitting elements to the propeller 3; these transmitting elements consist of a substantially horizontally extending shaft line S1 in the upper part of the steerable propeller, a transmission shaft S2 supported in a housing 4 and extends beneath the water level, a propeller shaft S3 which, in the operating position, extends substantially horizontally below the water level is rotatably supported in the lower part, or underwater housing 5, also referred to as the pear 5, and includes angle drives, for example, bevel gearings G1 and G2 for drivingly connecting the mentioned shafts. The housing 4 is coupled with the part 6 of the steerable propeller, which part is fixedly connected to the watercraft, through a universal joint ring 7. The universal joint ring 7 is rotatably supported about a substantially vertical axis in the said fixed part 6 with a substantially vertically spaced pair of pins, of which only the lower pin 8 is illustrated. The control or steering drive 9 engages the upper pin. The control axis, (that is, the axis of the pin pair) is inclined at a small angle with respect to the vertical. The housing 4,5 which carries the propeller can pivot with the universal joint ring for the purpose of control about the axis of the pair of pins.

In addition, a horizontal shaft 10 is provided which is formed of bolts or the like and which are secured at one end to the universal joint ring 7 and at the other end to the housing 4. The housing 4,5 can be tilted with the propeller 3 out of the water about the axis of the horizontal shaft 10 or the propeller can be pivoted about this shaft 10 for the purpose of trimming. (The term trim means a swinging of the propeller about the axis of the shaft 10 in order to adjust same at an optimum at various inclinations about a horizontal transverse axis of the watercraft.) The connection between motor and the shaft which is supported in the upper part of the housing and belongs to the horizontal shaft line is provided by a universal joint or an equivalent type joint. For driving the tilting motion about the axis of the shaft 10, two lift cylinders 11 are provided. These lift cylinders are arranged relatively closely side-by-side in the cavitation plate 12. An outer cylinder 13 is provided in a cast piece for each lift cylinder 11 so that the lift cylinders 11 will each move with the housing 4 and be fixedly secured against movement with respect thereto. One inner cylinder 14 is supported and sealed in the outer cylinder. One piston 15 each is guided snugly in the inner cylinder 14. A piston rod 16 of the piston 15 extends through a cylinder head 17, which cylinder head 17 is sealed with respect to the outer cylinder and with respect to the piston rod. A gap or elongated spacing 18 exists between the outer cylinder and the inner cylinder.

A trailing piston 20 is guided freely movably snugly inside of the cylinder 14 between the piston 15 and the end of the cylinder 19 remote from the piston rod.

The outer cylinder has two connections 21,22 in order to selectively supply pressure medium, for example, oil to the cylinder. The oil to the one connection 21 is guided through the cylinder head 17 into a cylinder chamber 23. The oil of the other connection 22 is guided through the gap or spacing 18 behind the trailing piston 20 into a chamber 24.

Relief valves (not illustrated) are provided in the piston 15, which relief valves diminish in the usual manner pressure shocks in the cylinder chambers 23 by causing the oil to flow between piston 15 and trailing piston 20. Throttle valves or the like (also not shown) are provided in the piston 15, which throttle valves permit the oil to return into the cylinder chamber 23 when the pressure shock ceases.

Figure 2:
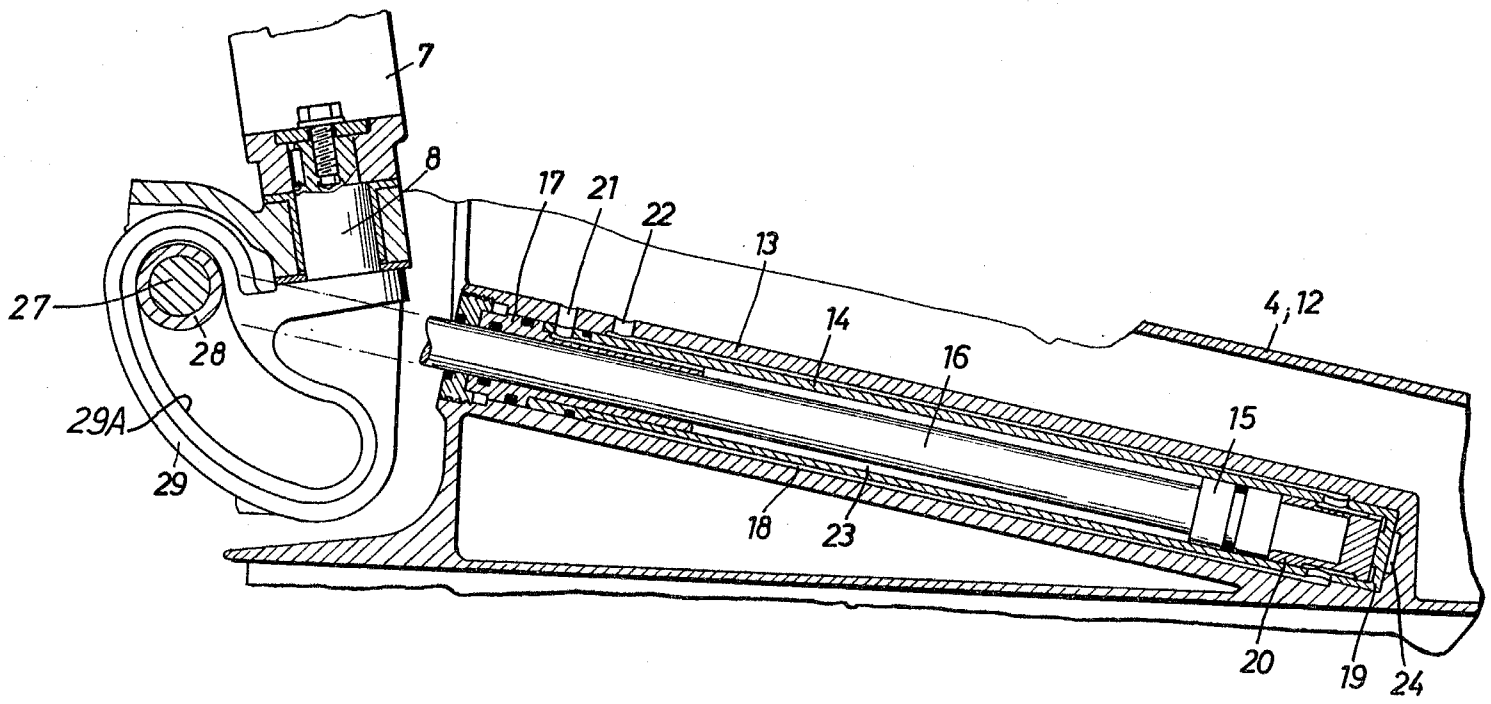
FIG. 2 illustrates in an enlarged scale a lift cylinder according to the invention.
Figure 3:
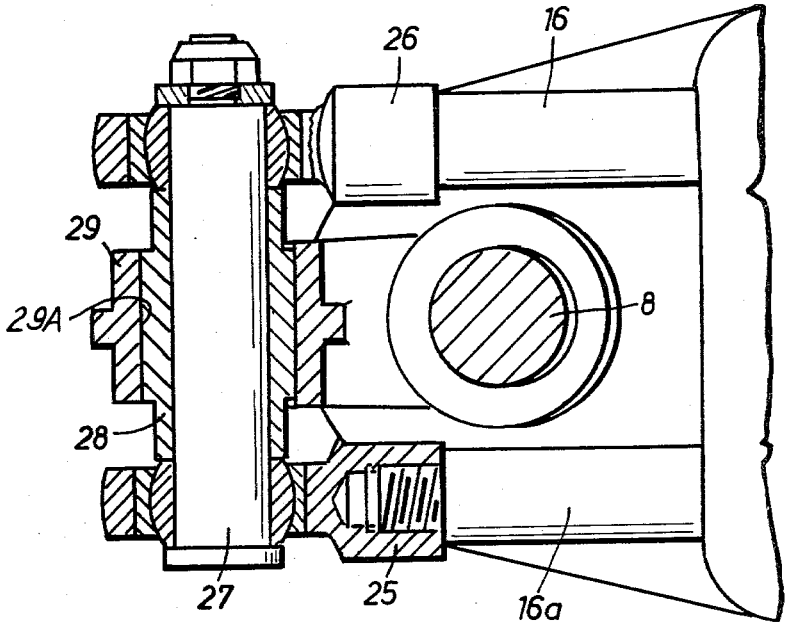
FIG. 3 illustrates in a further enlarged scale the hinging of the piston rods on a rocker arm according to the invention.

The piston rods 16,16*a* (FIG. 3) are connected together by means of rod heads 25,26 through a carriage or shaft 27. The shaft 27 is inventively supported in the rod heads with spherical bearings in order to avoid jammings. A roller 28 is rotatably supported on the shaft 27. The roller 28 is guided in an arcuate slot 29A in a rocker arm 29. The rocker arm 29 is secured to the universal joint ring 7 or the lower pin 8 in a suitable manner so that it also carries out the pivoting movement of the universal joint ring about the substantially vertical axis. A satisfactory operation is obtained with the rocker arm 29 during trimming and tilting of the propeller out of the water. In order for the rocker arm 29 to consume as little space as possible, it is designed curved or bent as is shown particularly in FIG. 2.

Due to the fact that the lift cylinders are arranged closely side-by-side, they need only one single, namely common, rocker arm 29.

For tilting the underwater housing 5 out of the water and for trimming, pressurized fluid, here oil, is more or less guided through the connection 22 behind the trailing piston 20 which causes a lifting of the housing 4,5 through the action of the pistons 15 and piston rods 16 and 16*a*. If the rudder fin 30 on the underwater housing 5 strikes an obstacle, then the overpressure valves, namely the relief valves, in the piston 15 become active and the housing 4,5 can tilt upwardly without causing the trailing pistons to change their position. The propeller 3 then assumes the original position again during the tilting back procedure.

Each lift cylinder 11 needs, in the common cylinder arrangement, one hydraulic main for supply and discharge of the pressurized fluid. In the arrangement of the lift cylinders according to the invention, the two lift cylinders 11 can be connected in the housing to the main in such a manner that only one common supply and discharge line is needed. Thus only two in place of four hydraulic hoses are needed for which the connections can be attached to the front side of the housing, where they interfere or hinder less with the flow.

Figure 4:
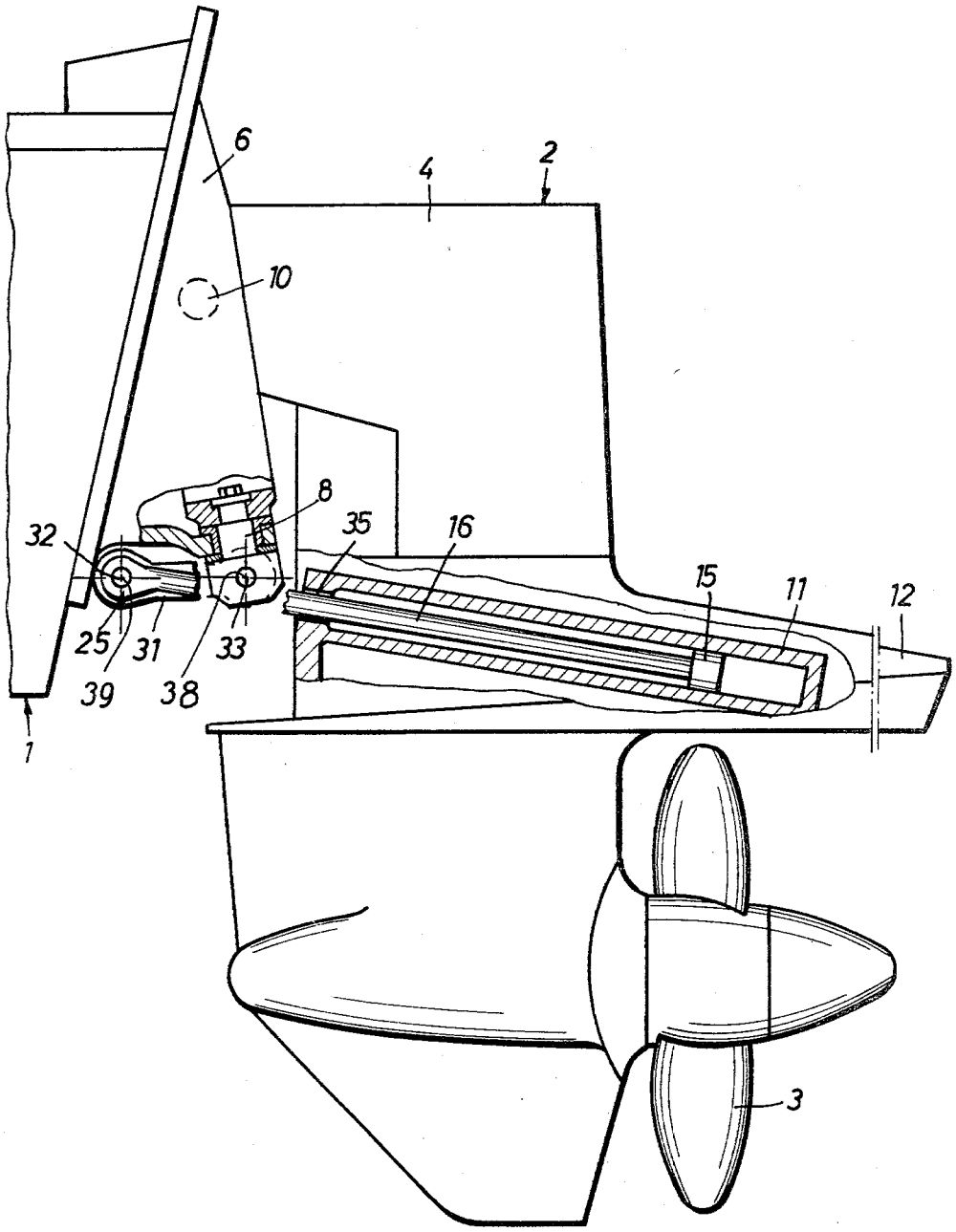
FIG. 4 is a simplified illustration of a steerable propeller according to the invention with hinging of the piston rods through steering knuckle arms.
Figure 5:
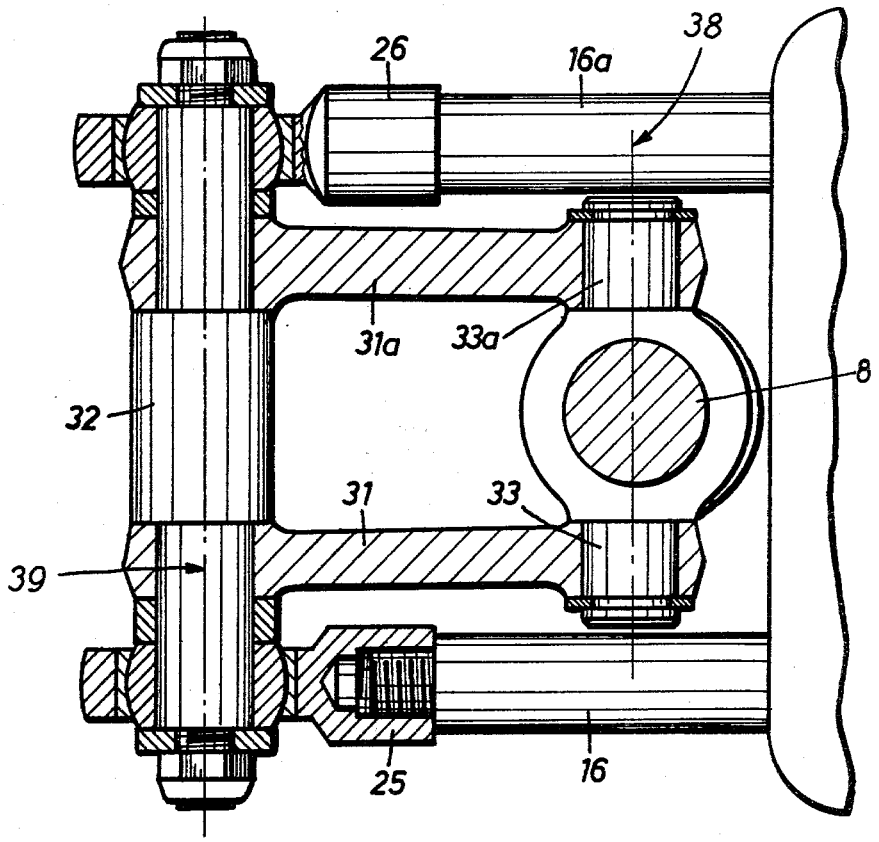
FIG. 5 illustrates in an enlarged scale the hinging of the piston rods through two steering knuckle arms according to the invention.

In place of the abovedescribed support of the two piston rods 16,16*a* through a roller 28 in a rocker arm 29, a support through at least one steering knuckle arm 31,31*a* can also be utilized (FIG. 4). The piston rods 16,16*a* are connected by means of rod heads 25,26 having a shaft 32 extending therethrough. The shaft is inventively supported in spherical bearings in the rod heads to avoid jammings. The steering knuckle arms 31,31*a* are rotatably supported on the shaft. At their other end they are also supported rotatably on the pins 33,33*a* which define a first pivot axis 38, which pins are secured in a suitable manner on the universal joint ring 7 or the lower pin 8, so that the steering knuckle arms also carry out the pivoting movements of the universal joint ring about the substantially vertical axis (FIG. 5). The pivotal movement of the knuckle arms 31 and 31*a* about the axis of the shaft 32 defines a second pivot axis 39.

Figure 6:
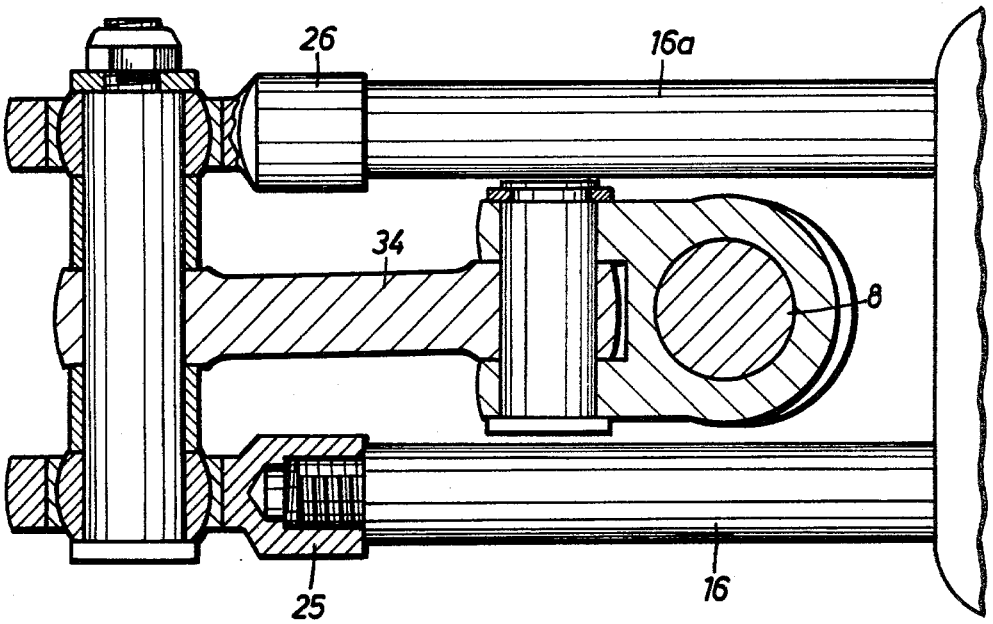
FIG. 6 illustrates a different exemplary embodiment for the hinging of the piston rods through a steering knuckle arm according to the invention.

In order to obtain a width of construction which is as small as possible, the steerable propeller or Z-drive can be supported also with only one steering knuckle arm 34 (FIG. 6).

Figure 7:
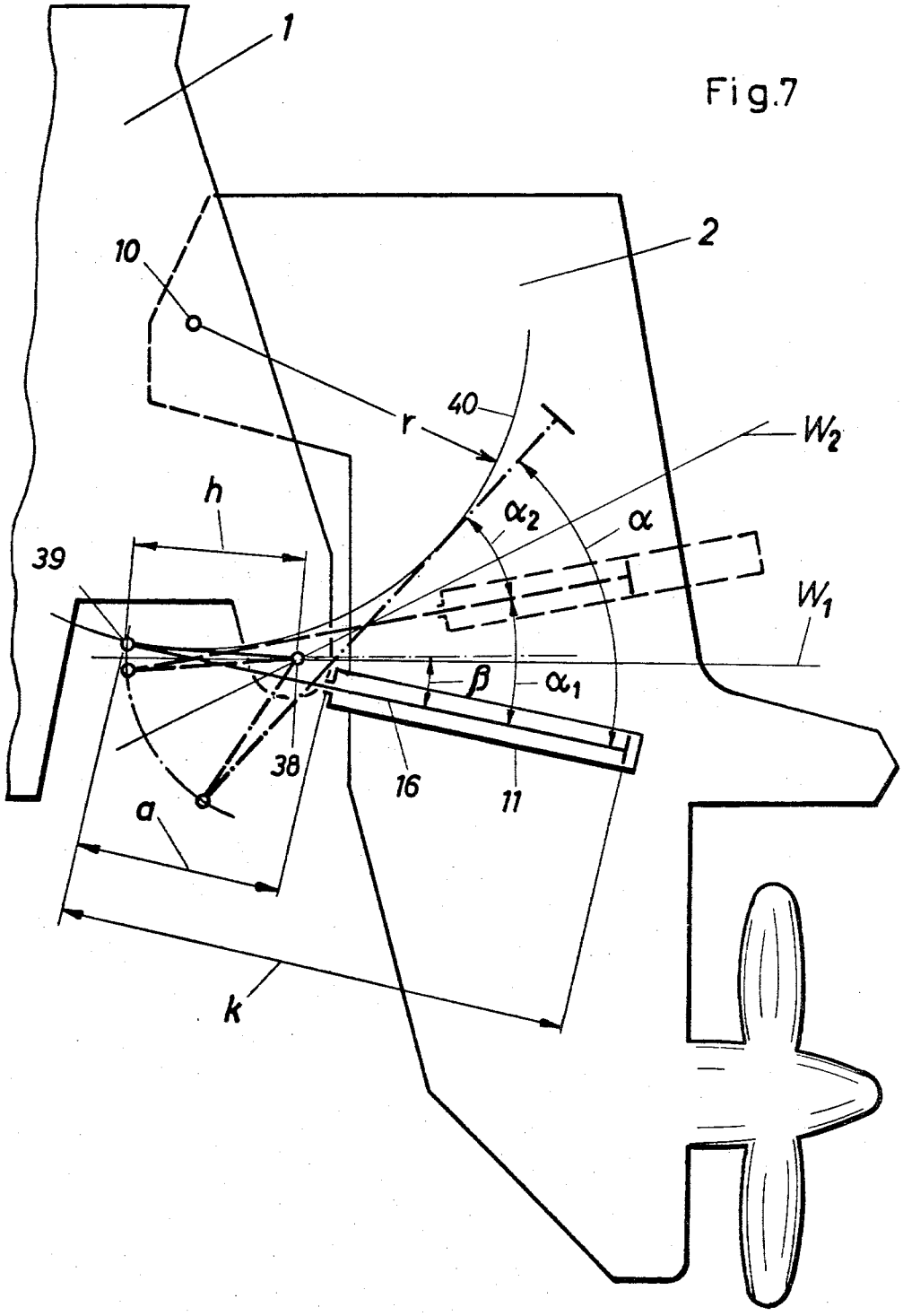
FIG. 7 illustrates in various positions the operation according to the invention.

The support through at least one steering knuckle arm results in a satisfactory operation during trimming and tilting of the propeller out of the water. However, it is obvious that in the case of this operation a side force N (FIG. 8) acts onto the piston rod, which depends in its size from the respective position of the piston with respect to the hinge point 38 (FIG. 7). During the course of the pivoting movement, the piston rod remains free from side forces only when its axis goes through the point 38.

The first step to achieve this is to place the hinge point or first pivot axis 38 so that during the course of the pivoting movement, the axis of the piston rod extends as often as possible through the point 38. That is, the hinge point 38 is to lie on the angle bisector of the angle of traverse defined by the extreme limit positions for the piston rod when the housing is pivoted between its limits of movement. This is possible two times at a maximum in the requested pivoting range, expressed by the traverse angle $\alpha$, in the described applied example.

The second step considers the fact that the traverse angle $\alpha$ or maximum angle of movement is composed in the exemplary embodiment of two sub-range steps $\alpha_1$ and $\alpha_2$: the step $\alpha_1$ is the maximum trim angle and is primarily passed through during trimming, wherein high support forces occur (coming from the propeller thrust), while the step $\alpha_2$ is used only during a tilting of the housing 4,5 out of the water, wherein only small forces occur which are caused by the weight of the steerable propeller. In order to hold the forces N,F (FIG. 8) which act onto the piston rod 16,16*a* and in the rod guideway 35 as small as possible, it is possible to assume an analogue with the thinking of the first step in first approximation that the optimum hinge point 38 lies on the point of intersection of the angle bisectors $W_1$, $W_2$ of the angles $\alpha_1$ and $\alpha_2$ defined by the position of the axes of the piston rods at the start and at the end of the respective sub-range steps $\alpha_1$ and $\alpha_2$. This thinking is fully true for the side force N which engages in the end point 39 of the piston rod.

Figure 9:
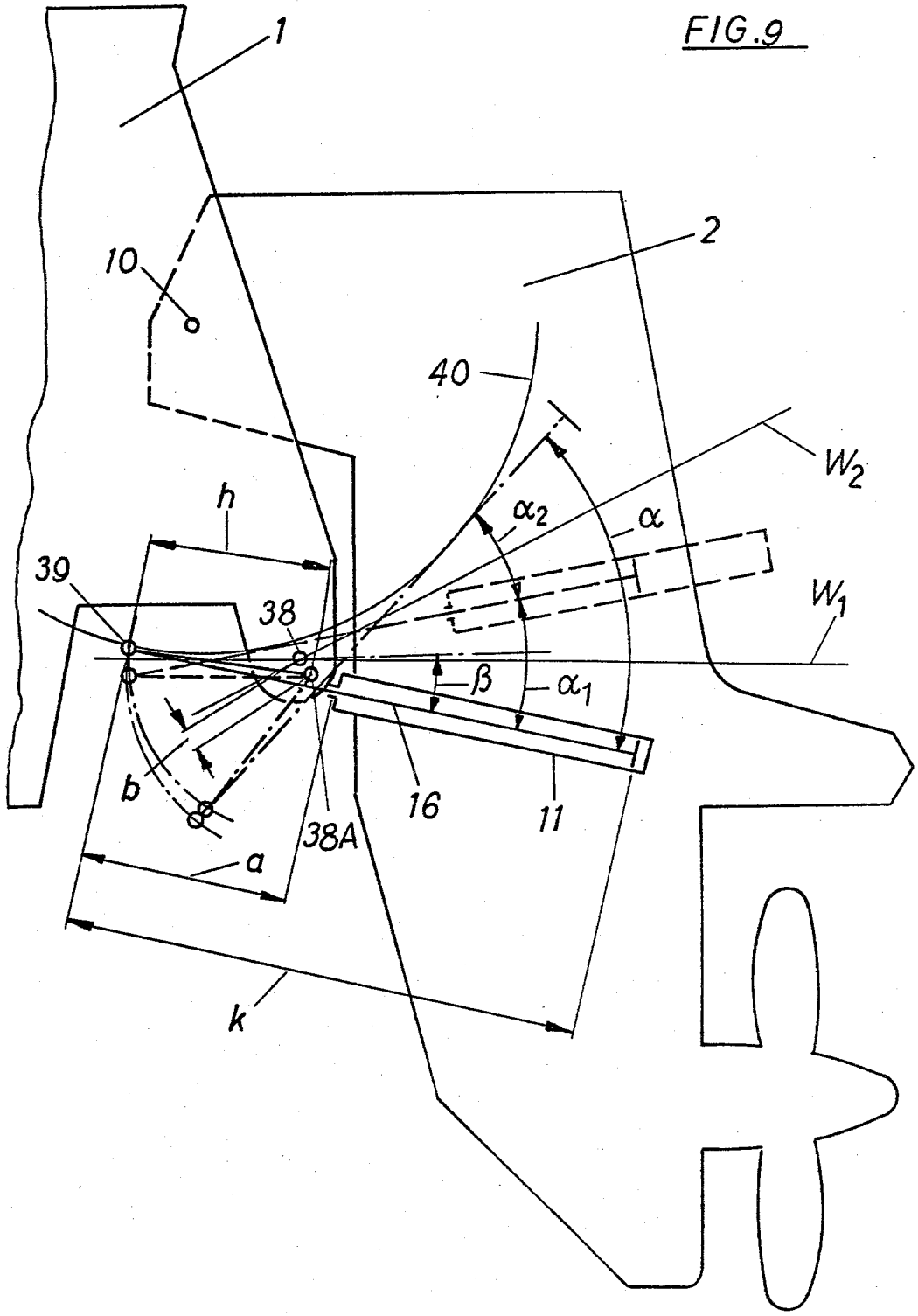
FIG. 9 illustrates in various positions the operation with the pivot axis 38 in FIG. 7 being located at the new position 38A.

The force which stresses the rod guideway for surface pressure and the piston rod for bending depends, however, in addition also from the projecting length a, namely from how far the piston rod is extended out of the cylinder. This projecting length increases with an increasing lift angle $\alpha$. From this follows that the optimum position of the point 38 must be moved from the above-mentioned point of intersection of the angle bisectors closer to the piston rod position at the end of the pivoting range in order to compensate for the unfavorable influence of the projecting length. This optimum position must be found through iteration and is achieved when bending tension and surface pressure is of equal size at the start and at the end of each of the two pivoting ranges. FIG. 9 illustrates the shifting of point 38 closer to the piston rod at the end of its pivoting range as indicated by the point 38A.

Aside from the angle of traverse $\alpha$ and the projecting length a, there are further parameters which have an influence on the position of the pivot point 38: The length h of the steering knuckle arm 31,31*a*,34 must be at least as great as the greatest vertical distance from the point 38 with respect to the axis of the piston rods 16,16*a*. The greater the length h is, the smaller is the side force N, the support force F and the bending tension $\delta_b$ in the piston rods.

The length k of the piston rods 16,16a influences through the projecting length a the relationship of the side force N at point 27 with respect to the support force F in the rod guideway. Thus the value k-a should be as large as possible at the end of the pivoting movement.

The radius r of the pitch circle 40 influences the absolute size of the entire operation, it is thus a reference magnitude for all length dimensions. The magnitude of r depends in the first place from the dimensions of the aggregate structure which is to be pivoted.

Figure 8:
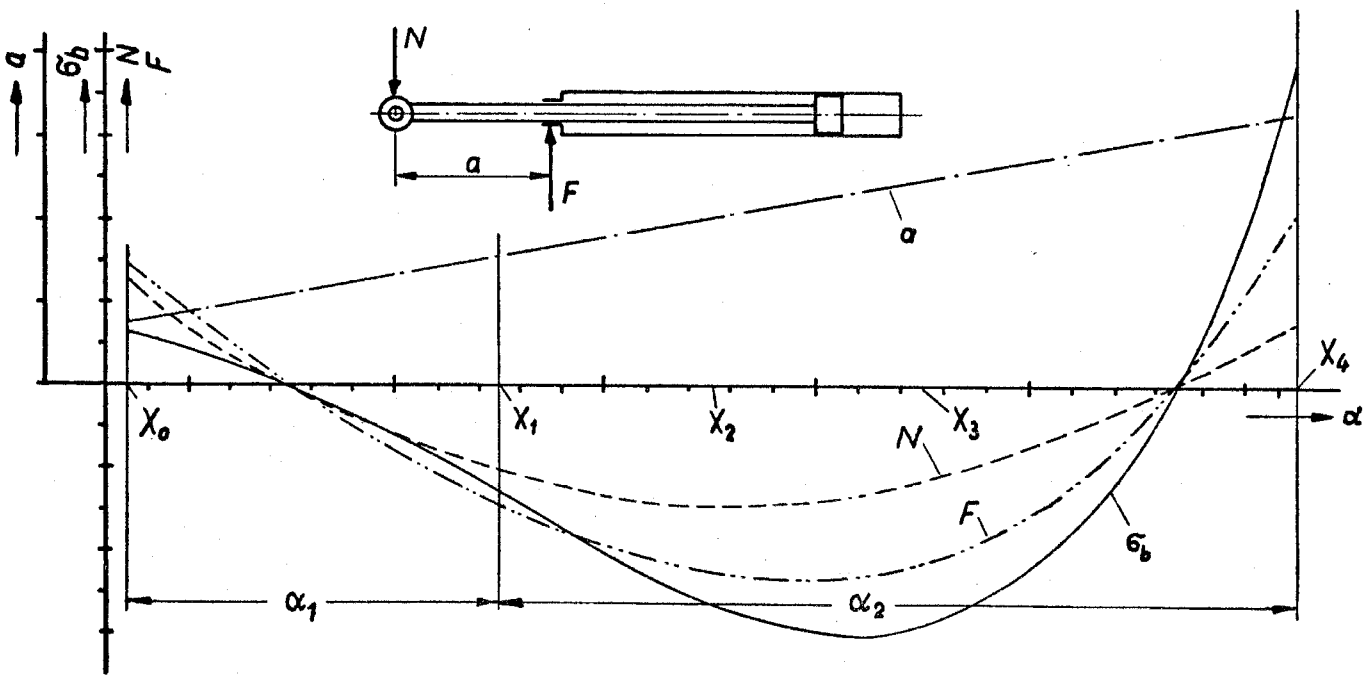
FIG. 8 illustrates a diagram of the forces which occur during the operation according to the invention.

The angle of impulse $\beta$ is substantially structurally based. By suitably choosing $\beta$, the position of the entire kinematics with respect to the pivot axis 10 is determined just like the position of the hinge point 38 with respect to the aggregate structure to be pivoted. By changing $\beta$, the zero passage of the load values can be varied or the largest positive and negative values of the forces N and F can be adapted to one another (FIGS. 7 and 8). Through this an optimum force distribution is achieved for example in the pivoting range $\alpha_1$.

FIG. 8 illustrates the important magnitudes of the side force N, support force F and bending tension $\delta_b$ of an optimized kinematics for a steerable propeller. The trim range extends from $X_0$ to $X_1$ (equals $\alpha_1$) and the initially made requirement for equal maximum values at the start and at the end of a range for the support force F has been realized. In this example, the course of the bending tension $\delta_b$ could not at the same time be adjusted to this request, however, by suitably choosing the rod cross section it is possible to meet in a known manner the strength requirements of the rod material.

A maximum is passed through for all three values in the angle range $X_2$ to $X_3$ in the lifting range $X_1$ to $X_4$ (corresponds to $\alpha_2$). After a reduction to the value zero all three values increase steeply again toward the end of the lift range. Here too the requirement for equal maximum support forces is approximately realized. The two other values follow again their fundamental relationships and are unaffected by external variables.

The extraordinarily high amounts for the three magnitudes are purely hypothetical. It has been assumed that over the entire operating range $X_0$ to $X_4$ the full propeller thrust is effective, which is true only for the trim range. The device is, in the lifting range as already mentioned, only loaded by the weight of the steerable propeller, possibly increased by a corresponding thrust increase. From this result substantially smaller stresses.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a lifting device for use with a Z-drive arrangement for watercrafts having a drive motor and a propeller and a transmission shaft arrangement which extends from said drive motor below the water level to said propeller, said transmission shaft arrangement being positioned in a housing mounted for a pivotal movement relative to said watercraft about a substantially horizontal axis and at least one power lift cylinder for effecting a driven movement of said housing about said horizontal axis, the improvement comprising wherein said lift cylinder is fixedly secured to said housing for movement therewith and against movement with respect thereto, said lift cylinder having a piston reciprocally mounted therein and a piston rod secured at one end to said piston, said lift cylinder having a rod guideway at the point where said piston rod exits therefrom, and a steering knuckle arm connecting the other end of said piston rod to said watercraft, said steering knuckle arm being pivotally secured to said watercraft about a first pivot axis, said other end of said piston rod being pivotally secured to said steering knuckle arm about a second pivot axis, and compensating means for facilitating a change in the location of said second pivot axis relative to said watercraft as said housing pivots about said horizontal axis, said compensation means including means on said steering knuckle arm spacing said second pivot axis from said first pivot axis, said first and second pivot axes being parallel to each other, wherein the angle of movement ($\alpha$) through which said housing traverses comprises two angles, a first angle ($\alpha_1$) corresponding to the maximum trim angle through which said housing is moved for trim adjustment and a second angle ($\alpha_2$) corresponding to the angle through which said housing is moved between said maximum trim angle and the maximum angle of movement of said housing, wherein said first and second angles each have an angle bisector which intersects with the other, and wherein said first pivot axis is spaced from the point of intersection of said angle bisectors toward said piston rod at the end of the pivoting range.

2. In a lifting device for use with a Z-drive arrangement for watercrafts having a drive motor and a propeller and a transmission shaft arrangement which extends from said drive motor below the water level to said propeller, said transmission shaft arrangement being positioned in a housing mounted for a pivotal movement relative to said watercraft about a substantially horizontal axis and at least one power lift cylinder for effecting a driven movement of said housing about said horizontal axis, the improvement comprising wherein said lift cylinder is fixedly secured to said housing for movement therewith and against movement with respect thereto, said lift cylinder having a piston reciprocally mounted therein and a piston rod secured at one end to said piston, said lift cylinder having a rod guideway at the point where said piston rod exits therefrom, and a steering knuckle arm connecting the other end of said piston rod to said watercraft, said steering knuckle arm being pivotally secured to said watercraft about a first pivot axis, said other end of said piston rod being pivotally secured to said steering knuckle arm about a second pivot axis, and compensating means for facilitating a change in the location of said second pivot axis relative to said watercraft as said housing pivots about said horizontal axis, said compensation means including means on said steering knuckle arm spacing said second pivot axis from said first pivot axis, said first and second pivot axes being parallel to each other, wherein the angle of movement ($\alpha$) through which said housing traverses has an angle bisector, and wherein said first pivot axis is spaced between the angle bisector and the piston rod when the piston rod is at the end of the pivoting range therefor.

* * * * *